US006543769B1

(12) United States Patent
Podoloff et al.

(10) Patent No.: US 6,543,769 B1
(45) Date of Patent: Apr. 8, 2003

(54) SNOWBOARD APPARATUS

(75) Inventors: Robert M. Podoloff, Framingham, MA (US); Steve Potter, Jamaica Plain, MA (US)

(73) Assignee: Slingshot Game Technology, Inc., Framingham, MA (US)

( * ) Notice: Subject to any disclaimer, the term of this patent is extended or adjusted under 35 U.S.C. 154(b) by 0 days.

(21) Appl. No.: 09/415,198

(22) Filed: Oct. 7, 1999

Related U.S. Application Data

(60) Provisional application No. 60/103,339, filed on Oct. 7, 1998.

(51) Int. Cl.[7] ..... A63F 1/10

(52) U.S. Cl. ..... 273/148 B; 273/148 R; 273/317.1; 273/460; 273/461; 463/1; 463/7; 463/23; 463/36; 463/47; 280/842; 280/87.042; 482/51; 482/900; 482/901; 482/902

(58) Field of Search ..... 273/148 B, 148 R, 273/317.1, 329, 330, 109, 309, 441, 442, 444, 449, 460, 461; 463/7, 9, 23, 36, 37, 38, 47

(56) References Cited

U.S. PATENT DOCUMENTS

| | | | | | |
|---|---|---|---|---|---|
| 3,834,702 | A | | 9/1974 | Bliss | 273/86 B |
| 4,408,613 | A | | 10/1983 | Relyea | 128/670 |
| 4,512,567 | A | | 4/1985 | Phillips | 272/73 |
| 4,607,839 | A | | 8/1986 | Knudson | 272/97 |
| 4,711,447 | A | | 12/1987 | Mansfield | 272/73 |
| 4,720,789 | A | | 1/1988 | Hector et al. | 364/410 |
| 4,751,642 | A | | 6/1988 | Silva et al. | 364/413 |
| 4,783,069 | A | | 11/1988 | Cottee | 272/97 |
| 4,817,950 | A | * | 4/1989 | Goo | 273/148 B |
| 4,966,364 | A | | 10/1990 | Eggenberger | 272/111 |
| 5,049,079 | A | | 9/1991 | Furtado et al. | 434/253 |
| 5,139,261 | A | | 8/1992 | Openiano | 273/148 B |
| 5,152,691 | A | | 10/1992 | Moscarello | 434/147 |
| 5,195,746 | A | * | 3/1993 | Boyd et al. | 273/148 B |
| 5,277,426 | A | | 1/1994 | Gerpheide et al. | 273/185 B |
| 5,277,678 | A | | 1/1994 | Friedebach et al. | 482/70 |
| 5,320,593 | A | * | 6/1994 | Heatwole | 482/146 |
| 5,405,152 | A | | 4/1995 | Katanics et al. | 273/438 |
| 5,433,683 | A | | 7/1995 | Stevens | 482/70 |
| 5,462,503 | A | | 10/1995 | Benjamin et al. | 482/4 |
| 5,516,105 | A | | 5/1996 | Eisenbrey et al. | 273/148 B |
| 5,545,115 | A | | 8/1996 | Corcoran | 482/146 |
| 5,591,104 | A | | 1/1997 | Andrus et al. | 482/7 |
| 5,613,690 | A | * | 3/1997 | McShane et al. | 273/449 |
| 5,645,513 | A | | 7/1997 | Haydocy et al. | 482/57 |
| 5,713,794 | A | | 2/1998 | Shimojima et al. | 463/36 |
| 5,745,055 | A | * | 4/1998 | Redlich et al. | 341/20 |
| 5,860,861 | A | | 1/1999 | Lipps et al. | 463/36 |
| 6,022,272 | A | * | 2/2000 | Sano | 463/36 |
| 6,139,473 | A | * | 10/2000 | Koyama et al. | 482/8 |

* cited by examiner

*Primary Examiner*—Valencia Martin-Wallace
*Assistant Examiner*—Binh-An D. Nguyen
(74) *Attorney, Agent, or Firm*—Wolf, Greenfield & Sacks, P.C.

(57) ABSTRACT

A simulator for snowboarding, skateboarding, water skiing and the like includes a substantially flat board having a support which permits three degrees of freedom of motion. The support can include a convex body which, in combination with a thrust receiving surface, forms a thrust bearing permitting the three degrees of freedom. The support can also include a rotary or turntable type of bearing permitting rotary motion. The simulator is instrumented to measure rotational motion and to provide an output signal compatible with a personal computer (PC) game port or a video game console input/output (I/O) port representative of rotational position of the board.

27 Claims, 7 Drawing Sheets

SNOWBOARD APPARATUS

This application claims the benefit of provisional application No. 60/103,339 filed Oct. 7, 1998.

BACKGROUND

1. Field of the Invention

The invention relates to sporting apparatus in general and more particularly to sporting apparatus which simulates the motion and sensations of a snowboard, skateboard, water-ski, or other similar sporting apparatus. Yet more particularly, the invention relates to such a motion simulator which can interact with a software program whose display gives a user visual feedback corresponding to movements of a snowboard, skateboard, water-ski or the like.

2. Related Art

Numerous sporting apparatus are known, including some which require a user to balance on a platform, or the like. For example, snowboards, skateboards and water-skis have a user balance on a platform which is free to move in a range of different directions. In each of these sports, the platform travels through a substantial distance or area, requiring the sport to be practiced either outdoors or in a large facility built for the purpose. For example, snowboarding requires a ski mountain, skateboarding requires a large open space or skateboard park and water-skiing requires a large body of open water.

Sports simulation games for personal computers (PCs) or the wide array of video game consoles, such as Nintendo 64, Sony Playstation, Sega Saturn, etc., are constantly striving to achieve greater and greater levels of realistic game play. In order to more fully immerse users in the game-playing environment, game designers have employed ever increasing levels of computer power to provide realistic sights and sounds for the user. However, the physical limitations of common gaming interface devices significantly interfere with a truly realistic gaming experience. Using a keyboard, a mouse, a conventional joystick or even a new generation force-feedback joystick to control for example an alpine snowboarding game, provides only a small fraction of the true physical experience because such controls lack the physical sensations of actually balancing on and controlling the snowboard platform. Some large, substantially non-portable simulators are known for practicing skiing, snowboarding and the like in an arcade environment. See, for example, Shimojima et al., U.S. Pat. No. 5,713,794. Some smaller devices are also known, such as those disclosed by Lipps et al. in U.S. Pat. No. 5,860,861 and Eggenberger in U.S. Pat. No. 4,966,364. However, all of these are either too bulky for home use, do not allow the range of motion inherent to real snowboarding, skateboarding, water skiing or the like, or do not interact with a computer software program to provide visual feedback corresponding to a user's motions.

There is therefore, a need for a device which provides a more realistic simulation of the true physical experience of snowboarding while also being able to interact with the current video gaming platforms such as PCs and video game consoles. Such a device would also allow those new or unaccustomed to the motions required in snowboarding to experience some of the physical sensations of the sport without the dangers inherent in such an activity.

SUMMARY OF THE INVENTION

An exercise device simulating a snowboard according to some aspects of the invention may include a platform; and a support including a thrust bearing, connected to the platform to permit three degrees of motion. The thrust bearing of the device may further comprise a body having a generally convex surface extending downwardly. The support of the device may further comprise a rotary bearing connecting the platform to the body for rotary motion. The device may include a position detector having an output connectable to a PC game port or a position detector having an output connectable to a video game console I/O port.

A method of simulating a physical activity according to other aspects of the invention may include steps of allowing movement in a measured direction; and facilitating the allowed movement by allowing additional movement in an unmeasured direction. The method can be practiced wherein the measured direction is rotary and the unmeasured direction is tilting.

In a game playing peripheral apparatus which supports a person, embodiments of the invention can include a support for the apparatus having three degrees of freedom and one measured direction of motion. The support may further comprise a body having a generally convex surface extending downwardly, and may further include a rotary bearing connecting the platform to the body for rotary motion. There may also be a position detector oriented to the measured direction, having an output connectable to a PC game port or a position detector oriented to the measured direction, having an output connectable to a video game console I/O port.

BRIEF DESCRIPTION OF THE DRAWINGS

In the drawings, in which like reference designations indicate like elements.

DETAILED DESCRIPTION

The invention will be better understood upon reading the following detailed description of some embodiments thereof in connection with the accompanying figures.

Figure 1:
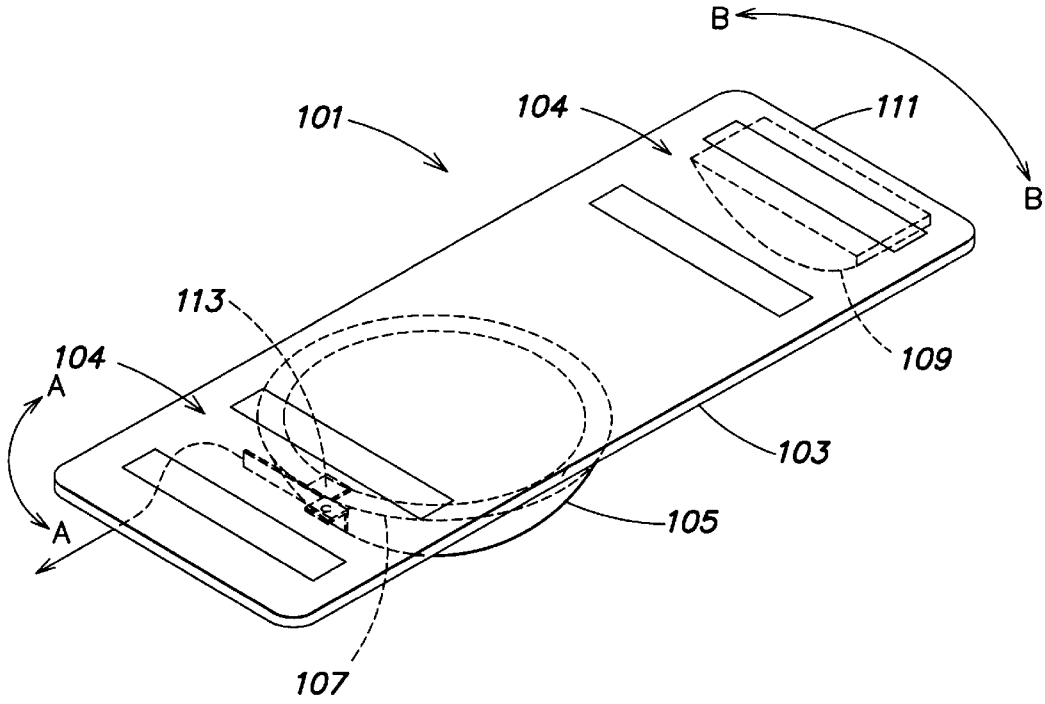
FIG. 1 is a perspective view of one embodiment of a snowboard simulating device.
Figure 2:
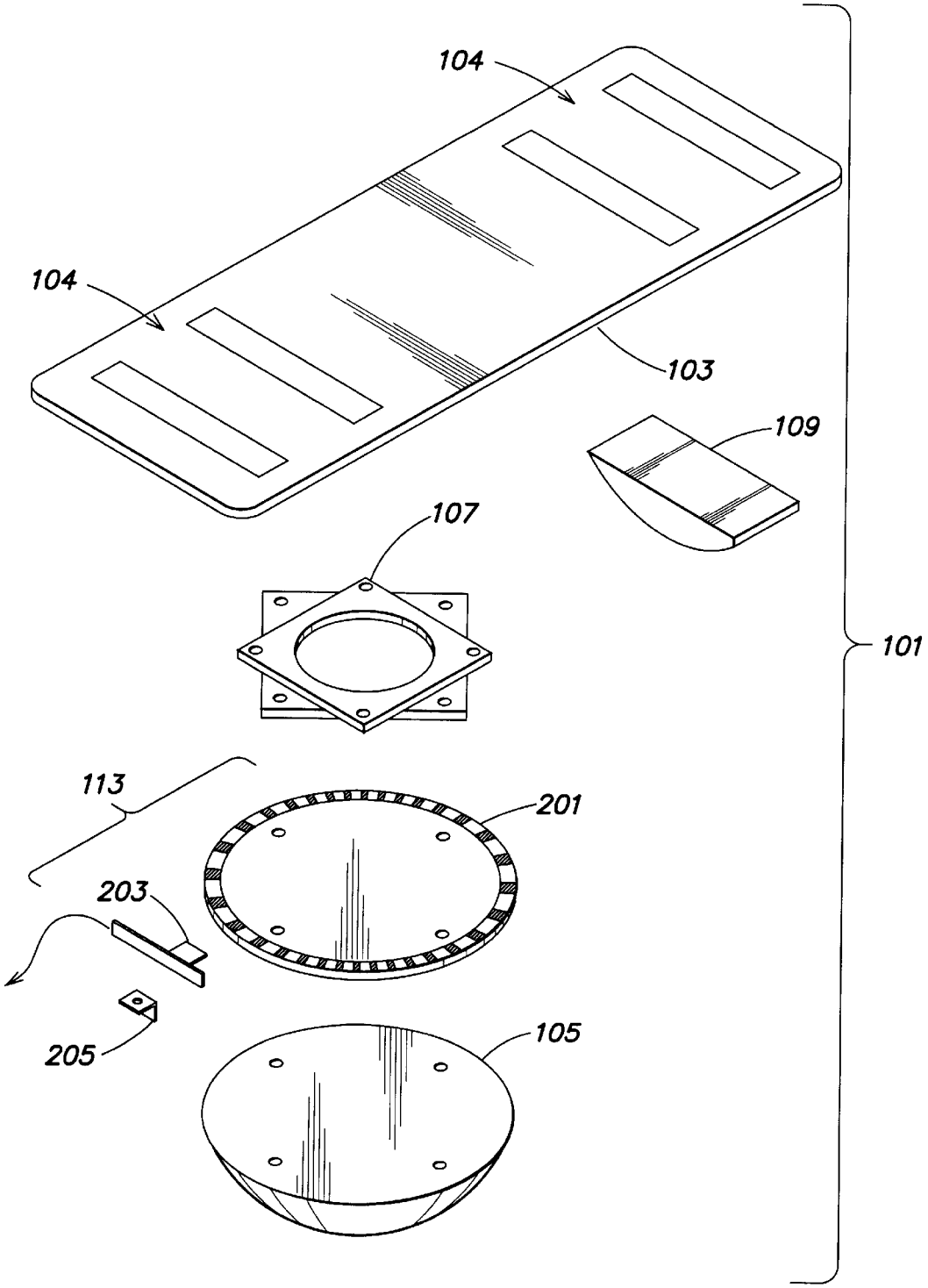
FIG. 2 is an exploded view of the device of FIG. 1.

As shown in FIG. 1, a snowboard simulator apparatus 101 features a generally rectangular top platform 103 on which the user stands with one foot positioned in front of the other at about shoulder width apart 104 (see FIG. 2). A convex body 105 is mounted to the top platform at a point between the intended positions of the users feet via a turntable-style bearing assembly 107. The mount point is preferably ⅔ of the way from the rear of the board. Moving the mount point to ⅓ of the way from the rear simulates surfing or skateboarding posture. The body 105 is preferably about 7 ½" diameter, 1" thick and having about a 1", ¼-round edge radius. A curved skid plate 109, located near the rear 111 of the simulator apparatus 101 allows the device to sit flat on the ground, yet still tilt A—A from side to side. As a user leans forward while standing on the apparatus the weight of the user is unloaded from the skid plate 109, allowing the device to more easily rotate B—B. The rotation B—B may be facilitated by movement of the turntable-style bearing 107 or by pivoting of the convex body 105 about a contact point with the ground.

Rotation of the board 101 about an axis between the user's feet has been found to be much more realistic than rotation about other axes, such as one placed forward of the device. Also contributing to the realism of the physical experience using the board 101 is the convex shape of body 105. The body 105 is convex around its entire surface, allowing the user to pivot in any direction while simultaneously rotating the board 101 in direction B—B.

In an embodiment of the device suitable as an input device to a PC or video gaming console, a dual channel optical encoder 113 or other rotary position sensor monitors the relative rotation B—B of the top platform 103 with respect to the convex body 105 which remains stationary relative to the ground during use of the board 101. The encoder should have a resolution of about 100 positions/180°, although more or less can also be used. During actual use, only about ±45° of movement occurs. The encoder could have a higher resolution, adjusted down by software executing on a microprocessor, the microprocessor embedded in an interface circuit such as described below in connection with FIG. 4, thus providing calibration. Also, a centering device, such as an elastic band or spring tying the body 105 to a fixed point on the board 103 should be provided. The centering device insures that the position sensor reports a reference position during calibration, when the position is not influenced by motion of a user. Additionally, thin film pressure sensors, membrane switches or other, similar devices (not shown) applied to contact surfaces of the convex body 105 and skid plate 109 are used to monitor the contact of the rear skid plate 109 and the convex body 105 with the ground on which they rest, thereby providing edging information to snowboard simulator software running on the PC or video game console. The information from the various sensors is read by the system electronics which connects through an input/output port of the PC or the video game console system.

Embodiments and aspects of the invention are now described in greater detail.

As shown in the exploded view of FIG. 2, the snowboard simulator apparatus consists of a top platform 103, rear skid plate 109, turntable bearing assembly 107, encoder wheel 201, convex body 105, dual channel optical sensor 203 and support bracket 205 (optical encoder 113 comprised of the elements 201, 203 and 205).

The top platform 103 is generally rectangular in shape and similar in appearance to a skateboard or snowboard. In one embodiment of the device, the top platform 103 is fabricated from ½" thick, high quality plywood with dimensions of 10" by 24". Plastics, fiberglass, composites and other materials known to the skilled artisan could also be used for the platform. It is understood that the platform could be manufactured using a wide range of methods and materials while achieving basically the same function. Although the top platform 103 should be basically flat, the ends can be curved, upturned or otherwise shaped for cosmetic appearance or to simulate the platform shape of a particular snowboard, skateboard or other device.

Figure 3:
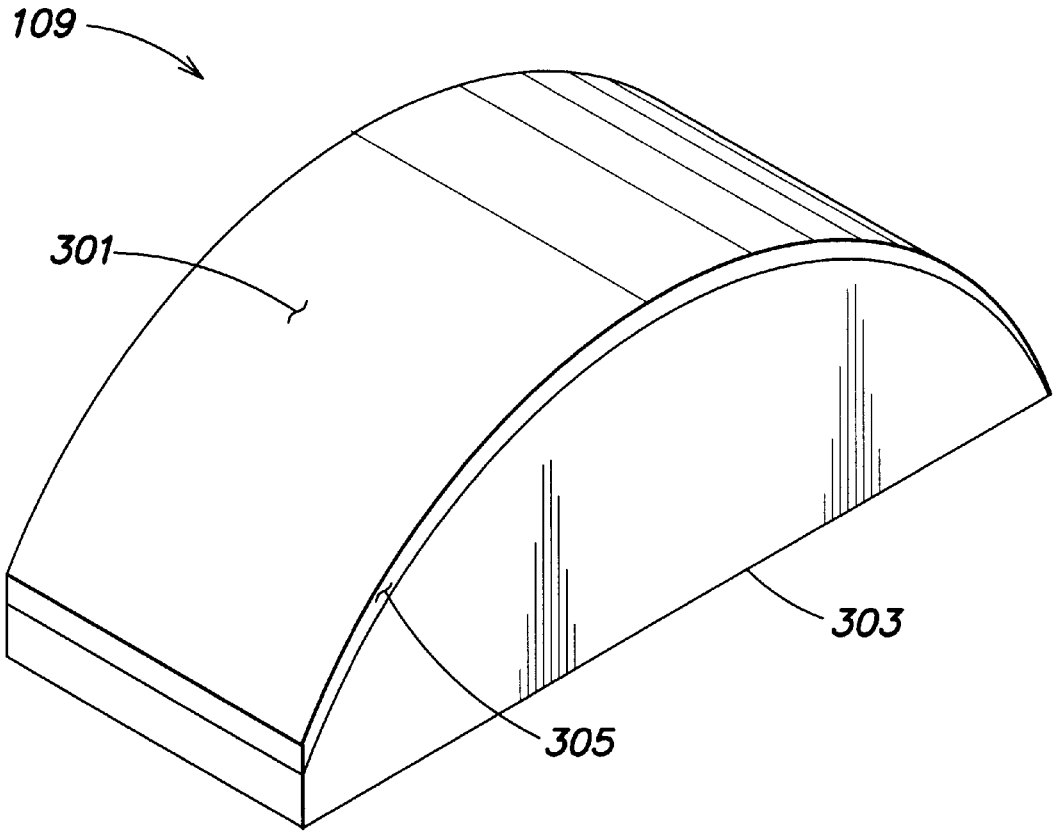
FIG. 3 is a perspective view of a skid plate for the device of FIG. 1.

The skid plate 109, as shown in FIG. 3, features a curved plastic surface 301 which slides smoothly when in contact with materials such as carpeting. The illustrative embodiment of FIG. 3 features a wood block 303 overlaid by a Delrin sheet 305. However, the skid plate 109 could be made of solid wood or molded plastic such as Teflon, or could be another solid substrate overlaid by any suitable low friction material, including Teflon.

In one embodiment of the snowboard apparatus, thin film tactile sensors (not shown) are mounted between the Delrin sheet 305 and the wood block 303 that make up the rear skid plate 109. In this configuration, the sensors have outputs which indicate the side to side tipping of the device 101. Detection of the side to side tipping triggers routines in one embodiment of the software which simulate the effect of edging. It is understood that other force sensing devices, membrane switches or other technologies could also be used to provide the same function. It is also understood that similar sensors could be used on the convex body to allow edging and front to back weight distribution to be monitored. Such information could be used by the software to compute and display a realistic body position for an on-screen simulated rider.

The above described sensing devices determine the motion of the snowboard apparatus in real space, so that motion can be simulated in a virtual world represented by the software. To this end, other position indicating methods can be used, for example laser or radio triangulation, magnetic field manipulation or robotic vision systems could be employed to determine the position of the snowboard apparatus. Other technologies available to monitor the rotation of the convex body relative to the top platform include but are not limited to potentiometers, hall effect sensors, magnetic induction methods and the like.

Figure 4:
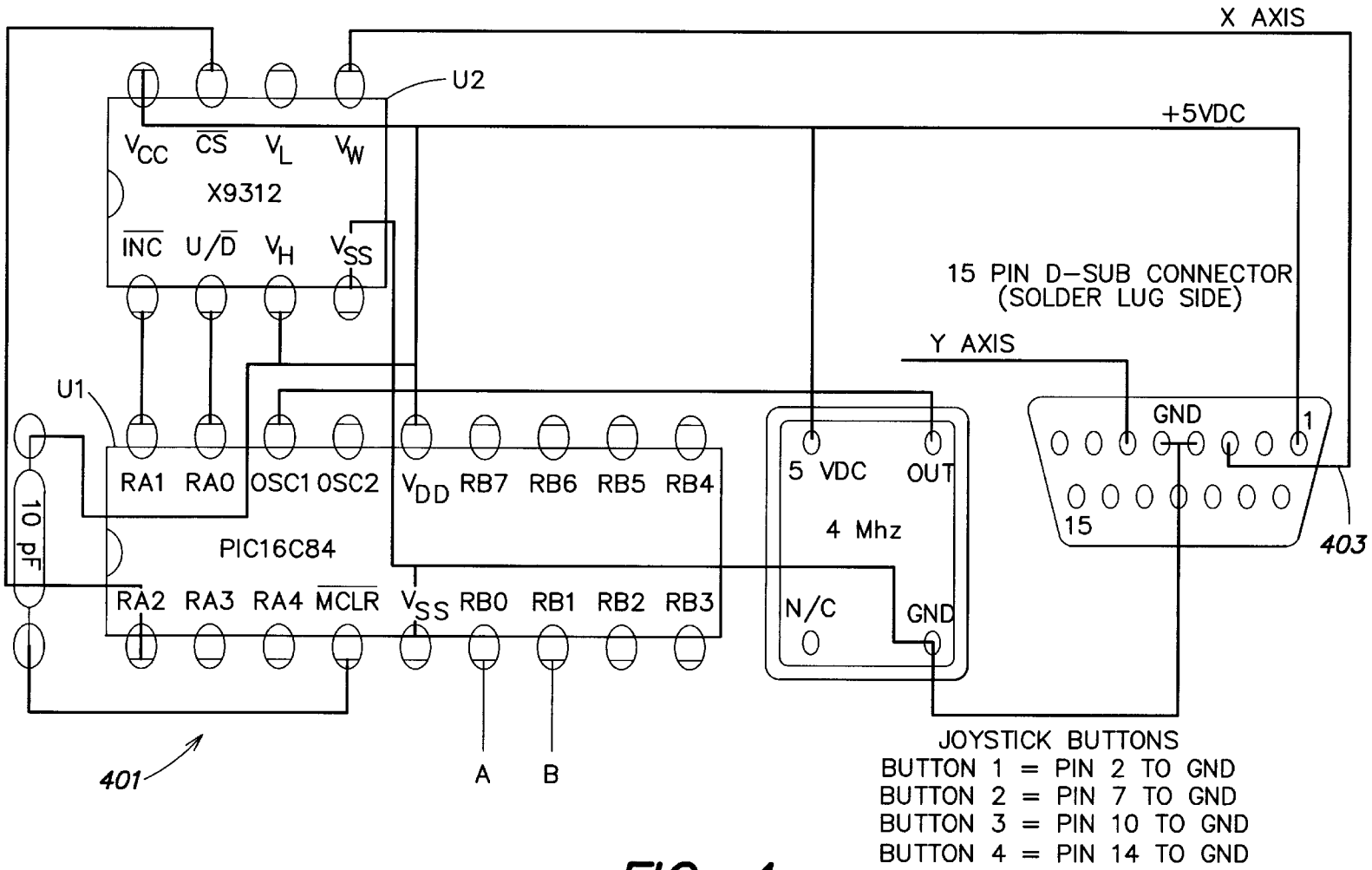
FIG. 4 is a pictorial view of an interface circuit connecting the device to a PC or video gaming console.

The position sensor connects to a PC or video game console through an interface circuit 401 such as that shown pictorially in FIG. 4. The circuit shown features an 8 bit microcontroller U1 and a digital potentiometer U2. The interface circuit 401 produces at least one output 403 which represents the position of the snowboard apparatus as a signal similar to that which a joystick produces to represent the position of the joystick. Thus, the snowboard apparatus 101 can connect directly to the game port of a PC, which is the I/O port to which a joystick is normally connected. The interface circuit firmware is responsible for reading the various sensors on the snowboard simulator and translating them into the appropriate joystick outputs. It should be understood by those skilled in this art that although the circuit illustrated connects the snowboard apparatus 101 to a PC game port, only slight modifications are required to connect the snowboard apparatus 101 to various video gaming console systems, such as Nintendo 64, Sony Playstation, Sega Saturn, etc.

Figure 5:
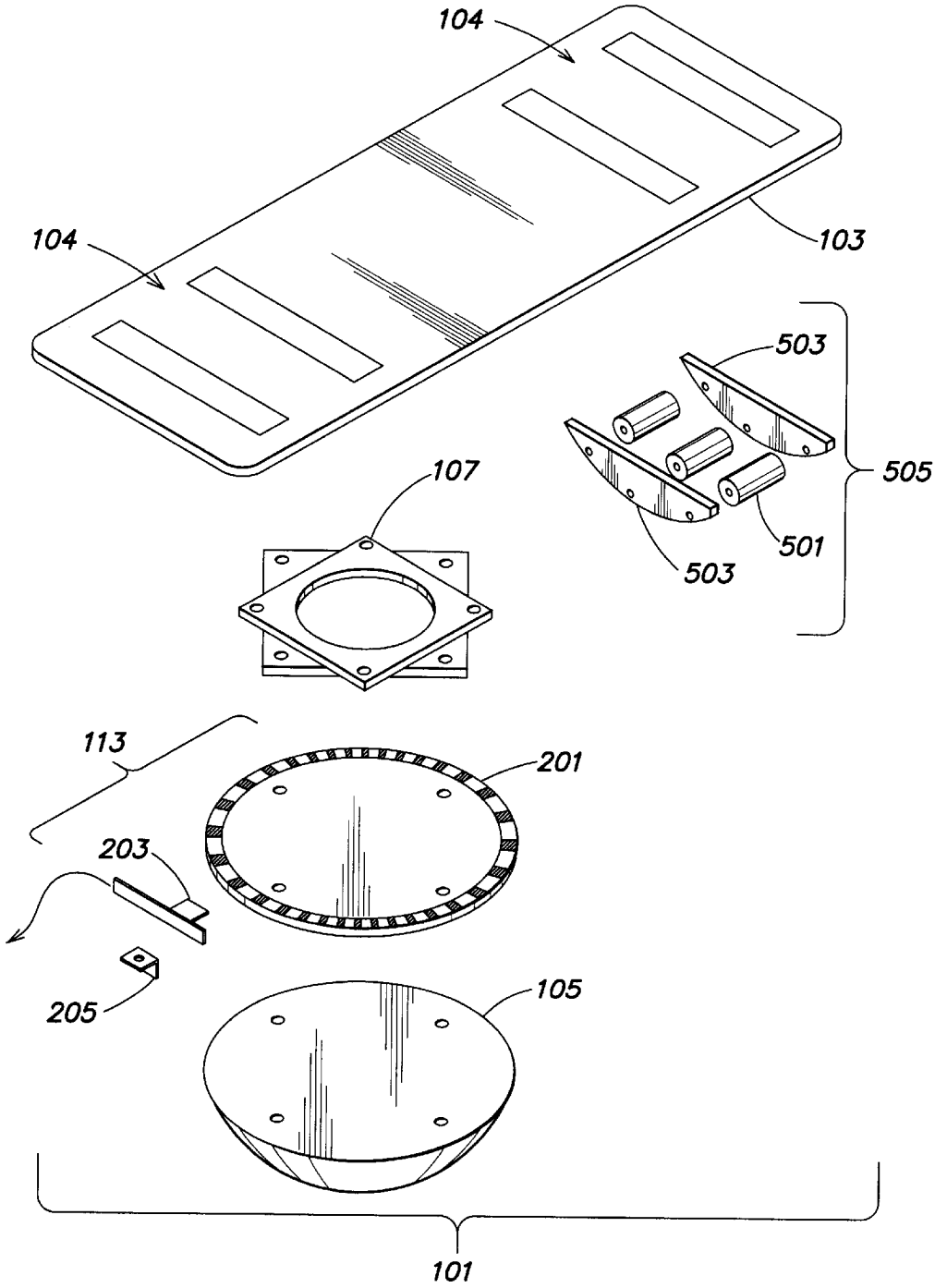
FIGS. 5 and 6 are exploded views of alternate embodiments of the device.

FIG. 5 presents an alternative embodiment of the snowboard apparatus in which the rear skid plate (FIG. 1, 109) has been replaced by a series of wheels or rollers 501 mounted in a frame 503. Although three rollers 501 are shown in the drawing, it is understood that either more or fewer wheels or rollers could be used. Like the skid plate 109, the rear roller assembly 505 can be instrumented with strain gauges, thin film force sensors or the like to determine how the operator is edging. This information can be used by the system software to influence the speed and direction of the virtual movement, i.e., the speed and direction of the movement displayed by the software to the user. Moreover, instead of a single assembly of rollers 505, as shown, two casters can be mounted at or near the rear corners of board 103. The wheels at the rear can instead be fixed wheels with their axles aligned with the center of rotation of the board 103. Alternate rear support designs which support the back of the board 103, but allow rotary motion of the board when slightly unweighted should now be evident to the skilled artisan.

Figure 6:
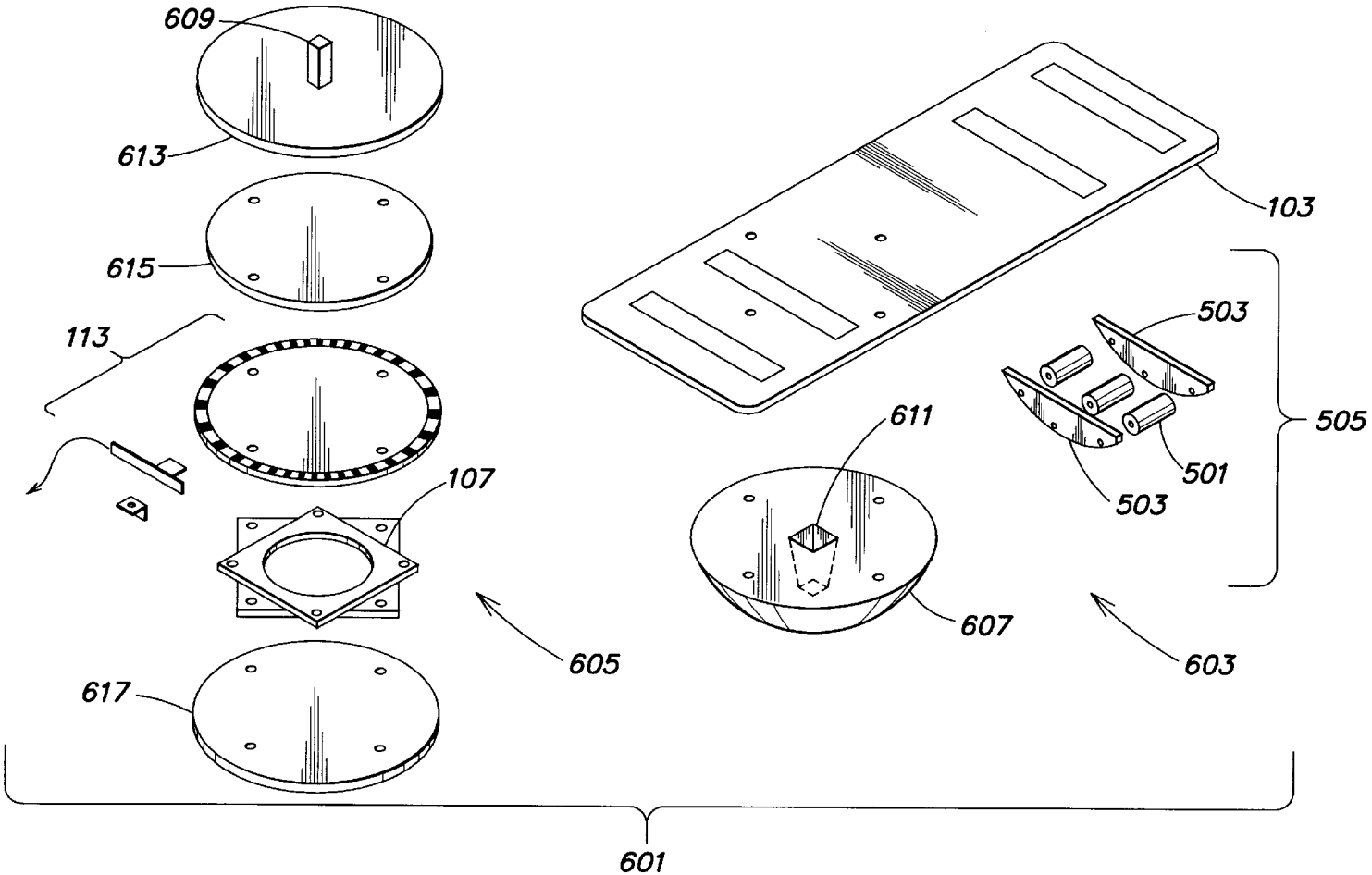

FIG. 6 presents still another alternative embodiment of a snowboard apparatus 601 in which the device 601 has been divided into two sub-assemblies 603, 605. One sub-assembly is a passive board assembly 603 which can be used independently. The other sub-assembly is an instrumented turntable 605. As shown in FIG. 6, the turntable assembly 605 features an optical encoder 113 or other sensor which produces an output signal representing the angular orientation of the device, similar to the integrated systems described above.

The board assembly includes a fixed, convex body 607 and one or more rear rollers or a skid plate, as described above. Therefore, the device is capable of both the front-to-back and side-to-side motion required. In one version of this device, the passive snowboard assembly 603 connects to the instrumented turntable 605 by a pin 609 having a square or rectangular cross-section. This pin mates to a complementary shaped hole 611 in the bottom of the convex body 607 of the snowboard assembly 601. The hole 611 has tapered sides, to accommodate front-to-back and side-to-side tilting of the board while still transferring the angular position of the board to the top portion 613 of the turntable 605. The amount of tilting can be monitored by thin-film force sensors or the like located on the top portion 613 of the turntable assembly 605. The top portion 613 of the turntable assembly 605 is connected to the turntable-type bearing 107 through mounting disk 615. Turntable-type bearing 107 is mounted to a base 617 which rests on the floor, for example, or is mounted to other components if desired.

It should be understood that numerous other methods are available for physically linking the board and turntable including friction methods, Velcro, and magnetic clutches. Additionally, the passive snowboard assembly can be used without the turntable if the snowboard assembly includes directional sensors or transducers such as gyroscopic, magnetic induction, RF triangulation, GPS, or accelerometer devices.

Figure 7:
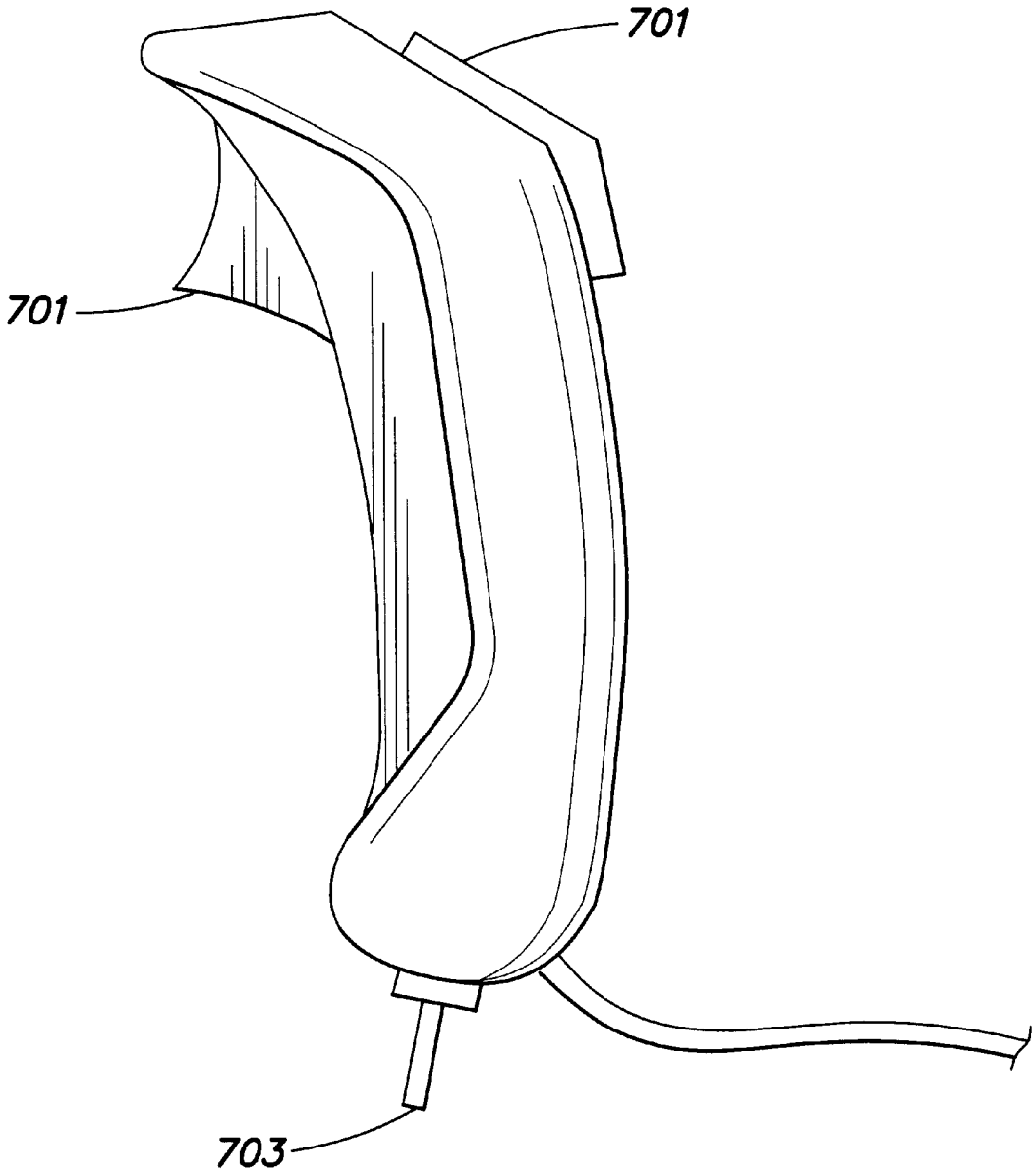
FIG. 7 is a pictorial view of an auxiliary hand control.

The system can further include an Auxiliary Hand Controller (AHC) connected to the interface circuit of FIG. 4 to provide button inputs and y-axis control. The Auxiliary Hand Controller (AHC), shown in FIG. 7, allows the user to access menu items and control certain trick motions while riding the board 103. In addition, the AHC provides the y-axis input sometimes required when using the board with 3rd party software titles, Sierra's Ski Racing, for example. The AHC shown in FIG. 7 includes two buttons 701 and a y-axis variable input 703. The AHC is connected to the interface circuit in a conventional manner using any suitable connector.

Some embodiments of the invention use two especially advanced pieces of software technology. First, there's the terrain engine, and second, there's the physics and animation of the boarder.

The terrain engine is capable of handling vast chunks of real-world topography, while allowing the level designer fine control over small details like moguls and jumps. The renderer automatically breaks the terrain into triangles on the fly to keep things looking good at a decent frame rate. The engine only uses triangles where it needs them. Mountains in the background of a rendered scene are actually rendered in 3D, not painted onto a flat backdrop. The entire terrain is rendered as a single, continuous mesh, covering a 64 km×64 km area. The other major piece of advance tech is the boarder physics/control/animation. The boarder is a true virtual snowboarder, bound by realistic board and figure physics, and animated completely in real time in response to user input and conditions in the game world.

The physics are fairly detailed, and so in order for the boarder to get down the mountain, there's a sophisticated controller layer that mediates between the inputs from the user and the physics of the engine. So when the user presses a button to make the boarder jump, the controller had to change the leg forces of the simulated figure, which feeds into the physics model and causes the figure's legs to push against the ground, resulting in vertical motion. Similarly, to keep the boarder from falling over, the controller has to continuously monitor the balance of the figure and in turn adjust the angle of the board, the center of mass of the figure in relation to the board (by moving the figure's legs and torso), as well as the downward leg forces. There's no motion capture or canned animation whatsoever. As a result the animation is far more realistic than a conventional snowboarding video game. When the boarder jumps, it looks like a jump because all the relevant forces are being modeled; when he falls down, it's because he just couldn't stay upright due to the terrain conditions, his linear and angular momentum, and the input from the user.

The present invention has now been illustrated by the description of several embodiments thereof. Numerous variations and other embodiments, incorporating the principles of the invention which will now be apparent to those skilled in the art are contemplated as falling within the scope of the invention, which is limited only by the appended claims and equivalents thereto.

What is claimed is:

1. A device for simulating a boarding sport, comprising:

a board for supporting a user of said device;

a first convex support member, attached to said board, that provides three degrees of freedom to said board;

a thrust bearing, coupled to said board and said first support member, the thrust bearing having an axis of rotation and allowing for rotation of said board relative to said first convex support member;

a second support member, attached to said board, that provides at least one degree of freedom, simulating edging motion; and an angular position detector that detects an angular position of said board about said axis of rotation of said thrust bearing relative to a position of the first convex support member.

2. The device of claim 1, wherein the first convex support member is disposed between the thrust bearing and a floor.

3. The device of claim 1, wherein the thrust bearing is disposed between the user's feet.

4. The device of claim 1, wherein the angular position detector further comprises an output connectable to a video game console I/O connection.

5. The device of claim 1, wherein the angular position detector comprises an encoder wheel that encodes an angular position of the board.

6. The device of claim 1, wherein the angular position detector comprises an optical encoder that encodes an angular position of the board.

7. The device of claim 1, further comprising at least one rolling support member that provides the at least one degree of freedom simulating an edging motion.

8. The device of claim 7, wherein the at least one rolling support member comprises at least one fixed wheel having an axle aligned with a center of rotation of the board.

9. The device of claim 1, further comprising an auxiliary hand controller (AHC) and associated software linking the board to a computer.

10. The device of claim 9, wherein the computer and the AHC allow the user to access selections from a plurality of sporting motions simulated on the computer.

11. The device of claim 1, wherein the boarding sport is any of snowboarding, skateboarding and water-skiing.

12. A method for simulating a boarding sport, comprising:

providing a board to support a user;

providing three degrees of freedom using a first convex support member, attached to said board;

providing at least one degree of freedom that simulates edging motion, using a second support member, attached to said board;

providing an electrical indication signal from a detector to an interface circuit, said signal indicative of an angular position of said board relative to said first convex support member; and providing an output signal from said interface circuit to a computerized simulator program, said output signal providing a real-time indication of said board's angular position.

13. The method of claim 12, wherein providing the electrical indication signal comprises sensing an optical signal corresponding to the angular position of the board relative to the first convex support member.

14. The method of claim 12, further comprising transmitting the angular position of the board to an output connectable to a video game console I/O connection.

15. The method of claim 12, further comprising pivoting the first convex support member about a contact point in contact with a floor.

16. The method of claim 12, further comprising accessing software options from a plurality of sporting motions simulated on an associated game machine.

17. A system for simulating a boarding sport, comprising:

a board for supporting a user;

a first convex support member, attached to a face of said board, allowing three degrees of freedom for movement of said board;

a thrust bearing allowing angular movement, about an axis of the thrust bearing, between said board and said first convex support member;

a second support member, attached to said face of said board and rearward from said first convex support member, wherein the second support member provides at least one degree of freedom for movement for said board, said at least one degree of freedom simulating an edging motion;

a position sensor, that senses an angular position of said board about said axis of the thrust bearing, and that provides an electrical output corresponding to said angular position relative to said first convex support member; and an interface circuit, receiving an input from said electrical output of said position sensor, and delivering an output signal to a computerized simulator program.

18. The system of claim 17, wherein the first convex support member is disposed between the thrust bearing and a floor.

19. The system of claim 17, wherein the thrust bearing is disposed between the user's feet.

20. The system of claim 17, wherein the position sensor further comprises an output connectable to the interface circuit.

21. The system of claim 17, wherein the position sensor comprises an encoder wheel that encodes an angular position of the board.

22. The system of claim 17, wherein the position sensor comprises an optical encoder that encodes an angular position of the board.

23. The system of claim 17, further comprising at least one rolling support member that provides the at least one degree of freedom simulating an edging motion.

24. The system of claim 23, wherein the at least one rolling support member comprises at least one fixed wheel having an axle aligned with a center of rotation of the board.

25. The system of claim 17, further comprising an auxiliary hand controller (AHC) and associated software linking the board to the computerized simulator program.

26. The system of claim 17, wherein the computerized simulator program and the AHC allow the user to access selections from a plurality of sporting motions simulated on the computerized simulator program.

27. The system of claim 17, wherein the boarding sport is any of snowboarding, skateboarding and water-skiing.

* * * * *